US005201953A

United States Patent [19]

Lowry

[11] Patent Number: 5,201,953

[45] Date of Patent: Apr. 13, 1993

[54] VEHICULAR PAINT APPLICATOR FOR CORRUGATED SURFACES

[76] Inventor: Joseph W. Lowry, 14498 Dan Patch Cir., Libertyville, Ill. 60048

[21] Appl. No.: 708,903

[22] Filed: May 31, 1991

[51] Int. Cl.[5] ..... B05C 9/00

[52] U.S. Cl. ..... 118/305; 239/148; 239/149

[58] Field of Search ..... 118/305; 239/148–150

[56] References Cited

U.S. PATENT DOCUMENTS

| | | | |
|---|---|---|---|
| 2,351,719 | 6/1944 | Stahl | 239/150 |
| 3,373,938 | 3/1968 | Sweet | 239/148 |
| 3,796,353 | 3/1974 | Smrt | 239/150 |
| 3,940,065 | 2/1976 | Ware et al. | 239/146 |
| 4,599,968 | 7/1986 | Ryder et al. | 118/305 |
| 4,831,958 | 5/1989 | Selby | 118/305 |
| 4,865,255 | 9/1989 | Luvisotto | 239/149 |

*Primary Examiner*—W. Gary Jones
*Assistant Examiner*—Charles K. Friedman
*Attorney, Agent, or Firm*—James P. Hanrath

[57] ABSTRACT

A continuous or intermittent vehicular paint applicator for applying paint to a corrugated surface, has one of four types of a carriage body attached to a wheel-roller skid assembly or a wheel tractor belt assembly. The carriage body and wheel-roller assembly or tractor belt assembly serves as a vehicular base for screw attachment of the component parts of the paint applicator including handle means, an electric power assembly, a paint can hold base assembly with puncture and drain means, and a fixture for securing a paint dispenser in a fixed position relative to the carriage body. Skid guards attached to the carriage body in the wheel-roller assembly embodiments of the invention extend laterally between each set of side wheels and extend downwardly beyond the carriage body to a point 1/16th to ¼th inch above the bottom of the wheels to minimize the fall of the vehicular paint applicator's wheels into the valleys of a corrugated surface no more than ¼th of an inch.

33 Claims, 8 Drawing Sheets

VEHICULAR PAINT APPLICATOR FOR CORRUGATED SURFACES

BACKGROUND OF THE INVENTION

1. Field of the Invention

The present invention is related to vehicular paint applicators, and more particularly to an intermittent or continuous vehicular paint applicator for corrugated surfaces.

2. Description of the Related Art Including Information Disclosed Under 37 CF-R Sections 1.97–1.99.

The art of vehicular paint applicators includes a variety of vehicular mounted spraying devices directed to applying a paint spray coating to generally flat surfaces or environments. Such vehicular paint applicators have been unsuitable on corrugated steel decking and other corrugated surfaces, which often may be used as a structural basis for flat building roofs. The present invention solves this need.

For Example, corrugated steel decking of flat roof buildings require welds or screwheads to attach the steel decking to structural steel members. Often building codes, architects, contractors, or building owners require the welds and/or screwheads to be painted over to stop or reduce corrosion or for aesthetic reasons. The corrugations of such steel decking used for roofs and floorings vary in the measurement between the high sections of the corrugations (flutes) and the width and spacing of the low section of the corrugations (valleys). When welds and/or screwheads are painted over on these corrugated support structures it was heretofore necessary for a painter to manually walk around the roof or floor with a paint container, and brush or paint sprayer, to manually paint the welds and screwheads as the corrugated nature of the roof or flooring prevented use of traditional vehicular paint applicators.

Welds and screwheads are usually located in the valleys of the corrugation. It is common for the welds and/or screwheads to be intermittently spaced and aligned relative to each other. Since structural corrugated decking can cover massive areas of commercial structures, manual painting of welds and/or screwheads is a tedious and time consuming task. The present invention discloses a light weight intermittent or continuous vehicular paint applicator capable of traversing the flutes and valleys of corrugated surfaces while providing means for easy sensing of aligned welds and/or screwheads for applying a controlled or limited burst of paint spray directly thereon.

Specifically, the present invention includes a wheel roller-skid assembly to avoid a ride across corrugations that is unduly bouncy by minimizing the fall of the vehicle wheels into the valleys of the corrugated surface to no more than ¼th of an inch (preferably, 1/16th to ⅛th of an inch) by means of a skid guard of polyethylene or thermal plastic material attached to a carriage body. Further, the vehicular paint applicator for corrugated surfaces of the present invention sets the spray of a paint applicator in such spaced relation to the front axle wheels of the vehicle that when an operator senses that the wheels have just fallen into a valley of corrugated surface, the operator is thereby signaled to commence jog control dispersal of a controlled or limited burst of paint spray at a determined point relative to the wheels directly over welds and/or screwheads.

In another embodiment of the invention a wheel tractor continuous belt looped in engagement around each side set of carriage body wheels allows movement across corrugations. In this embodiment a sensing limit switch is provided to sense when a limit switch wheel mounted to the carriage body has encountered a valley of the corrugated surface.

Prior art vehicular mounted spraying devices have been proposed to apply spray paint coatings under a variety of conditions. Such patents include:

| U.S. Pat. No. | PATENTEE |
|---|---|
| 4,865,255 | Luvisotto |
| 4,599,968 | Ryder et al. |
| 3,940,065 | Ware et al. |
| 3,373,938 | H. C. Sweet |
| 2,351,719 | R. Stahl |

U.S. Pat. No. 4,865,255 to Luvisotto discloses a sprayer and self container mobile pumping apparatus for spraying liquid herbicides, insecticides, fungicides, fertilizers, and the like. The sprayer includes an adjustable nozzle and is hand held for use in conjunction with a wheeled cart with upper and lower support shelves carrying a removable liquid storage tank on the upper shelve and a rechargeable battery and pump on the lower shelf.

U.S. Pat. 4,599,968 to Ryder et al. discloses a collapsible painting cart apparatus comprising a mobile frame, a receptacle for receiving a container of paint, and an extendible and retractable mounting and guide member for mounting the receptacle and for guiding the direction of the paint released from the container for depositing a strip or selected width of paint.

U.S. Pat. No. 3,940,065 to Ware et al. disclose an apparatus for spraying liquids directly from a paint container mounted on the apparatus wherein an electric drive motor, pump assembly, and paint container shelf are attached to a wheeled frame assembly for portable movement without disconnecting the paint container from the pump assembly.

U.S. Pat. No. 3,373,938 to H. C. Sweet discloses a boom directed marking device wherein a nozzle-supporting boom is mounted on a portable wheeled frame carrying a paint storage tank and a self contained source of pressurized air.

U.S. Pat. No. 2,351,719 to R. Stahl discloses a vehicular line marker apparatus for painting stripes or lines wherein a container for paint and compressed fluid has an engine driven compression unit to deliver the contents of the container tank to a spray gun associated with the machine. The spray gun is supported so as to be adjustable both vertically and traversely relative to the machine body to operate in conjunction with paint shields positioned at the respectively opposite sides of the spray gun such as to serve to define the edges of the paint line produced by the spray gun.

Such prior art patents provide vehicular mounted spraying devices generally unsuitable for traversing the flutes and valleys of corrugated steel decking and other corrugated surfaces. The present invention allows the vehicular paint applicator to traverse corrugated surfaces by minimizing the fall of the vehicular spray dispenser wheels into the valleys of the corrugated surface to no more than ¼th of an inch by means of a skid guard of a wheel roller-skid assembly or a wheel tractor belt assembly. Moreover, the present invention provides means for setting the spray of a paint applicator in such spaced relation to the front wheels and axle of the vehicular paint applicator such that when an operator senses that the paint applicator front wheels have fallen into a valley, the operator can then make jog control dispersal of a controlled or limited burst of paint spray at a determined point relative to the wheels thereby allowing accurate, efficient and fast painting of aligned welds and/or screwheads by applying a paint spray directly thereon without the operator visually having to locate the welds and/or screwheads or align a paint spray thereon. In the wheel tractor belt assembly embodiment of the present invention a limit switch senses the fall of a limit switch wheel from a flute into a valley of a corrugated surface to allow electric circuit dispersal of the burst of paint. Such operation allows for the vehicular painting of welds and/or screw heads of massive areas of structural corrugated decking in an efficient manner in far less time than manual painting of the welds.

SUMMARY OF THE INVENTION

According to the invention, there is provided a continuous or intermittent paint applicator for applying paint to a desired surface, preferably a corrugated surface, comprising a carriage body having two side walls or alternatively, at least four downwardly extending legs integral with or joined to an upper plate, each side wall or each of the four legs being attached near separate ends of a pair of wheel bearing axles; a wheelroller skid assembly having four wheels each of which are rotatably mounted near separate ends of a pair of wheel bearing axles, and a first skid guard attached adjacent to one side wall or to one side set of legs and a second skid guard attached adjacent to the other side wall or to the other side set of legs, each skid guard extending laterally between the wheels and extending downwardly beyond the side walls or four legs to a point 1/16th to ¼th inch above the bottom of the wheels; handle means attachable to the carriage body and extending upwardly therefrom for gripping by an operator to push or pull the carriage body relative to the surface; an electric power assembly mounted on said carriage body including interconnecting electric lines providing an electric circuit, and at least two electrical outlets, one for electric circuit communication with an electric power source and the other for electric circuit operation of an airless cup suction pump paint dispenser by a jog control switch capable of selectively activating an electric circuit to initiate and terminate the release of paint from the paint dispenser as desired; means attached to the carriage body for holding a paint container in fluid communication with means for delivering the contents of the paint can to a suction delivery line of the paint dispenser; and a fixture for securing the paint dispenser in a fixed position including a vertical rod attached to the carriage body at its lower end and mountably supporting a detachable horizontal arm at a selected distance above the lower end, the detachable horizontal arm including means for clamping the arm to the vertical rod in adjustable position vertically, traversely, or invertedly, and consisting of two portions, a first portion with means for locking this portion to a second portion to, when locked together, secure a squeeze trigger of the paint dispenser in operational mode.

Alternatively, the carriage body of the paint applicator of the present invention may have four downwardly extending axle legs integral with or joined to an upper plate, each leg being attached near separate ends of a pair of wheel bearing axles and a plurality of downwardly extending skid guard support legs integral with or joined to the upper plate and positioned between each side set of axle legs. The skid guard support legs and axle legs are dimensioned to be received into a corresponding plurality of leg receiving cavities of a first and second skid guard. Alternatively, the carriage body may have a plurality of downwardly extending axle legs integral with or joined to an upper plate, each leg being attached to an axle bearing a rotatable wheel. A wheel tractor belt assembly is provided having a continuous tractor belt looped in engagement around each side set of wheels. In this embodiment there is a sensing limit switch for mechanically sensing the flutes and valleys of a corrugated surface in relation to a set position of the spray nozzle of a power paint dispenser. The limit switch can initiate and terminate electric circuit dispersal of paint when the limit switch senses a valley of a corrugated surface.

The embodiments of the invention advantageously provide a vehicular paint applicator for corrugated surfaces capable of traversing various sized flutes and valleys of corrugated surfaces to intermittently apply paint to welds and/or screwheads of such corrugated surfaces in an efficient and accurate manner by means of a skid guard of a wheel-roller skid assembly which minimizes the fall of the vehicular paint applicator's wheels into the valleys of corrugated surface no more than ¼th of an inch. Further, means are provided to set the spray of a paint applicator in such spaced relation to the vehicular paint applicator's front wheels and axle such that when an operator of the applicator senses that the vehicle's front wheels have just fallen into a valley of a corrugated surface, the operator is thereby signaled to commence jog control dispersal of paint spray at a determined point relative to the wheels. In the wheel tractor belt assembly embodiment of the invention a sensing limit switch mechanically senses the fall of a limit switch wheel from a flute into a valley of the corrugated surface to allow electric circuit dispersal of the burst of paint. Such operation accurately applies spray paint to aligned welds and/or screwheads without the necessity of the operator having to visually locate the welds and/or screwheads and align the paint spray thereto after properly setting a horizontal arm securing a power paint dispenser.

Further it has been found to be highly desirable to achieve assembly mechanization of the various parts of the present vehicular paint applicator with maximum efficiency and minimum cost by having the carriage body and wheel roller-skid assembly serve as a vehicular base for screw attachment of the component parts of the paint applicator including handle means, an electric power assembly, a paint can hold base assembly with puncture and drain means, and a fixture for securing a paint dispenser in a fixed position relative to the carriage body. Still further, the vehicular paint applicator can be constructed to be of a relatively light weight compared to certain prior art vehicular paint applicators. This is advantageous given that the vehicular paint applicator of the present invention is best used to paint welds and/or screwheads of corrugated steel roof decking, thus the relative light weight of the vehicular paint applicator allows an operator to carry the same onto corrugated roof tops. Also the light weight of the present paint applicator allows an operator to tilt its forward end upward by a downward force on the handle means resulting in the paint dispenser distributing its jog controlled limited burst of paint spray in a greater radius to paint double welds or double screwheads at certain portions of corrugated steel decking.

Additional features and advantages of the present invention will become apparent to those skilled in the art from the following description and accompanying figures illustrating the preferred embodiment of the invention, the same being the present best mode for carrying out the invention.

BRIEF DESCRIPTION OF THE DRAWINGS

The foregoing and other features of the present invention will be more fully understood after reading the following description which refers to the illustrative exemplary embodiments shown in the accompanying drawings herein:

FIG. 3 further shows that the upper plate of the carriage body is tilted from front to back of the paint applicator to aid in the gravity drain of paint from a paint container through the piercing valve to the feeder body.

DESCRIPTION OF THE PREFERRED EMBODIMENT

Figure 1:
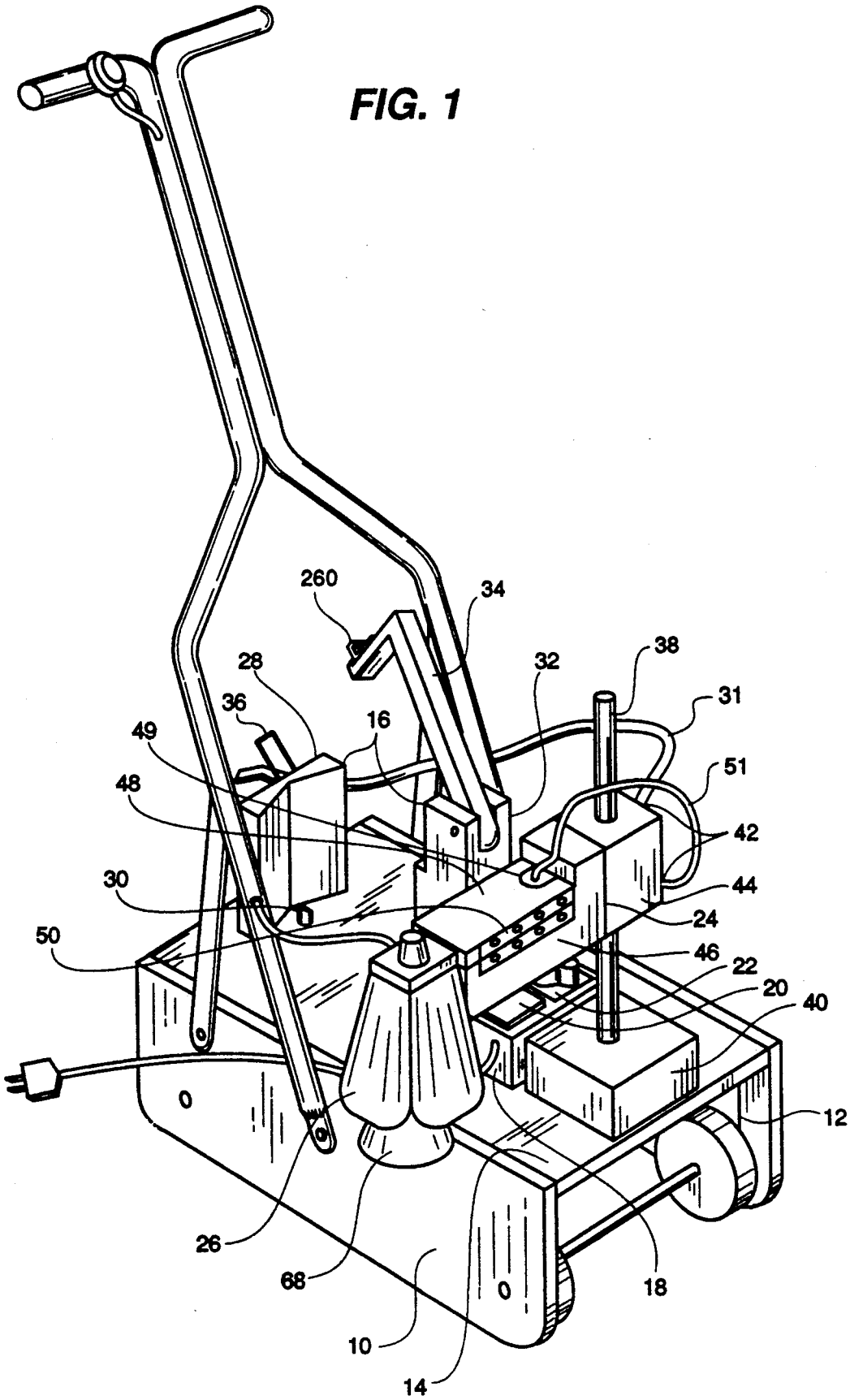
FIG. 1 is a perspective view of a vehicular paint applicator for corrugated surfaces constructed according to the teachings of the present invention and shows a wheel roller-skid assembly attached to a carriage body with handle means and jog control switch, paint can hold base assembly with puncture and drain means for the paint, an electric power assembly and a fixture for securing a paint dispenser in a fixed position mounted on the carriage body.

Referring now to the drawings, and more particularly to FIG. 1, there is shown a perspective view of a vehicular paint applicator for surfaces, particularly a corrugated surface, constructed according to the teachings of the present invention and shows a wheel roller-skid assembly 10 attached parallel to a carriage body 12. The carriage has an upper plate 14 whereupon there is mounted by screw or other means from rear to front respectively, a paint can hold assembly 16, electric power assembly 18 having at least two electrical outlets 20 and 22, and a fixture 24 for securing an airless cup suction pump paint dispenser 26 in a fixed position. The paint can hold assembly includes a paint can hold base 28, a paint can piercing valve 30 forward of said base, arm base 32 and clamping arm 34 for engagement with toggle lock 36 to secure a paint container over piercing valve 30 such that when the clamping arm is locked by the toggle lock, the paint can is forced downward over the piercing valve to gravity drain the contents of the can through piercing valve 30 to a feeder body for eventual delivery of paint to a suction delivery line 31 of an airless cup pump paint dispenser. Fixture 24 includes a vertical rod 38 attached to upper plate 14 at its lower end by support block 40 and mountably supporting a detachable horizontal arm 42 at a selectable distance above said support block. The detachable horizontal arm 42 includes clamping portion 44 for clamping said arm to the vertical rod 38 in adjustable position vertically, traversely, or invertedly. The horizontal arm 42 extends from said clamping portion 44 in two portions, a first arm portion 46 is internally contoured to support hand/trigger arm of an airless cup suction pump paint dispenser 26 and a second arm portion 48 having hinge 50 in common with first arm portion 46 and means for locking the second arm portion to the first arm portion thereby encapturing a squeeze trigger of the power paint dispenser 26 in operational mode when so locked. Second arm portion 48 has cavity 49 permitting power cord 51 of paint dispenser 26 to escape from and extend out of the first and second arm portions when they are locked together.

Figure 2:
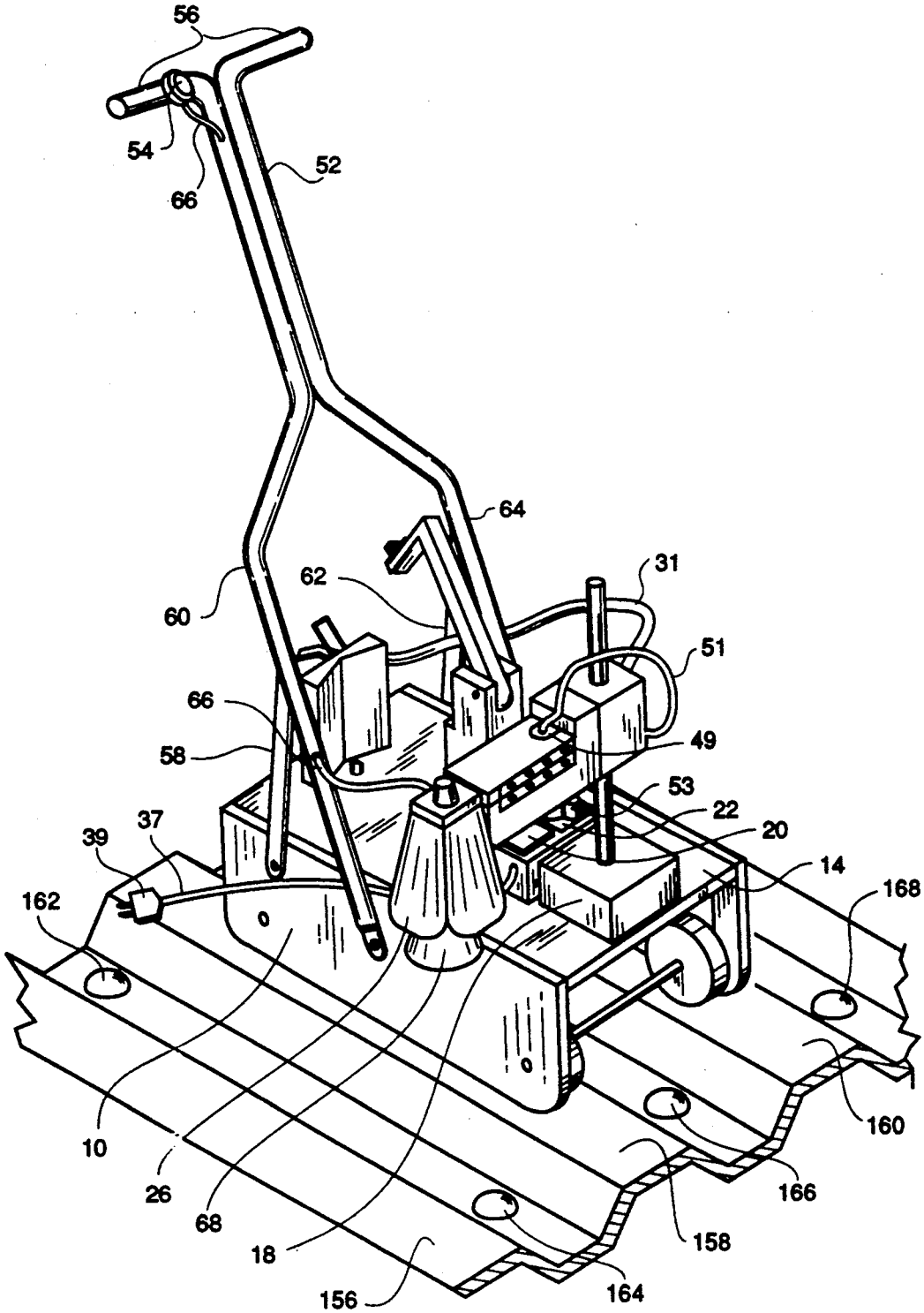
FIG. 2 is a perspective view of the vehicular paint applicator shown in FIG. 1 and shows the same on a corrugated decking surface with the wheels of the paint applicator set parallel atop the flutes of the surface.

Referring now to FIG. 2, there is shown a perspective view of the vehicular paint applicator of FIG. 1. Handle means 52 includes jog control switch 54 mounted on gripping portion 56 of the handle means and handle attachment legs 58, 60, 62, and 64 screwed or otherwise attached to the wheel roller-skid assembly 10. The jog control switch 54 is in communication with an electric line 66 capable of selectively activating an electric circuit to initiate and terminate the release of paint from paint applicator 68 as desired. Power assembly 18 mounted on the carriage body upper plate 14 by screw or other means of attachment is normally biased to a non-working position wherein an electric circuit is not operable to release paint from the paint dispenser 26 but rather is responsive to the operation of jog control switch 54 for releasing paint from the power paint dispenser 26. In this regard, power paint dispenser electric cord 51 terminating into plug 53 is set into switched electrical outlet 22 External power cord 37 terminating into plug 39 cooperates with an extension cord to establish electric circuit communication with an appropriate electrical power source and live outlet 20.

In FIG. 8 there is illustrated four different embodiments of the carriage body of the vehicular paint applicator of the present invention. At FIG. 8*a* carriage body 70 has two side walls 72 and 74 opposite each other integral with or joined at upper plate 76. At FIG. 8*b* carriage body 78 has four downwardly extending axle legs 80, 82, 84, and 86 integral with or joined to an upper plate 88 and aligned for attachment to separate ends of a pair of wheel bearing axles. At FIG. 8*c* there is illustrated a carriage body 90 having four downwardly extending axle legs 92, 94, 96, and 98 integral with or joined to upper plate 100 similar to FIG. 8*b*. Additionally, the carriage body 90 of FIG. 8*c* has a plurality of downwardly extending support legs 102, 104, 106, and 108 integral with or joined to upper plate 100, all legs being dimensioned and aligned to be received into a corresponding number of leg receiving cavities 110, 112, 114, 116, and 118, 120, 122, and 124 of a pair of skid guards 126 and 128 respectively which are illustrated exploded from the carriage body. FIG. 8*c* is the preferred embodiment of the paint applicator of the present invention and illustrates in exploded view the wheel roller-skid assembly 10 of FIG. 1. This embodiment is preferred since axle and support legs of the carriage body are set into and mechanically supported by corresponding support cavities of the skid guard to better disperse forces and loads while traversing corrugated surfaces. At FIG. 8*d* there is illustrated a carriage body 129 having a plurality of downwardly extending axle legs 130, 132, 134, 136, and 138, 140, 142, and 144, respectively aligned in pairs and integral with or joined to an upper plate 146. Each axle leg is designed to be attached near the end of a wheel bearing axle. Instead of a wheel roller-skid assembly attached to each side set of legs as shown in FIG. 8*c* and FIG. 1 a wheel tractor belt assembly is provided for each side set of wheels. The wheel tractor assembly includes first continuous tractor belt 148 and second continuous tractor belt 150 each looped in engagement around one side set of wheels. Limit switch sensor 152 located above limit switch wheel 154 is attached to the carriage body 129 and is aligned between forwardmost wheel bearing axle legs 136 and 144 to sense the fall of said limit switch wheel from a flute into a valley of corrugated surface to thereby allow electric circuit dispersal of a burst of paint. The limit switch sensor senses the flutes and valleys of a corrugated surface in relation to a set position of the spray nozzle 68 of paint dispenser 26 when the paint dispenser is held by horizontal arm 42 aligned with both the forwardmost wheel bearing axles 136 and 144 and limit switch wheel 154.

Preferably, the four embodiments of carriage bodies 70, 78, 90 and 129 are manufactured as an integral steel casting while the skid guards screwed or otherwise attached to carriage bodies 70, 78, and 90 are made of polyethylene or thermal plastic material to promote the skidding of the paint applicator across corrugated surfaces. Such manufacture further promotes the structural integrity of the carriage body serving as a vehicular base for the various component parts of the paint applicator while having the skid guard of lighter weight contributes to the total overall relative light weight of the vehicular paint applicators. Additionally, it is preferable that the upper plates 76, 88, 100, and 146 of the four carriage body embodiments be tilted with a one inch lengthwise rise from its rear end to front end as shown at FIG. 3 to aid in the gravity drain of container contents through the piercing valve 30 into feeder body 208.

Referring back to FIG. 2 there is illustrated the vehicular paint applicator shown in FIG. 1 on a corrugated field decking surface 156 with the wheels of the paint applicator riding parallel atop the flutes 158 and 160 of the corrugated surface. An operator by pushing or pulling on handle means 52 may propel the vehicular paint applicator atop such flutes in a direction parallel to the valleys of the corrugated surface. As corrugated decking may cover massive areas, particularly when used as roofing or ceiling of structures, the wheels may easily ride atop the flutes of the corrugation when running parallel to the valleys of the corrugation. FIG. 2 further illustrates that welds and/or screwheads 162, 164, 166, and 168 are typically affixed in the valleys of the corrugated surface in an intermittently spaced aligned manner. The corrugation of corrugated surface presents a barrier for prior art vehicular spray applicators to paint such welds and/or screwheads typically aligned and intermittently spaced in the valleys of corrugated surfaces. FIG. 2 also illustrates that if one desires to utilize a vehicular paint applicator to paint welds and/or screwheads 162, 164, 166, and 168 by a vehicle only capable of having its wheels traverse the raised flutes of a corrugated surface then the operator of the vehicle must make many travel paths atop the flutes to specifically visually align the spray from spray nozzle 68 over each weld and/or screwhead to apply paint thereon. The vehicular paint applicator of the present invention provides a more efficient and accurate method of applying paint to such welds and/or screwheads by allowing the vehicular paint applicator to traverse the flutes and valleys of the corrugated steel decking as observed in FIG. 3.

Figure 3D:
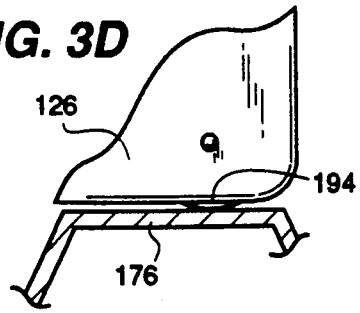
FIG. 3*d* shows in focal view the bottom of the front wheel of the paint applicator extending beneath the skid guard.
Figure 3A:
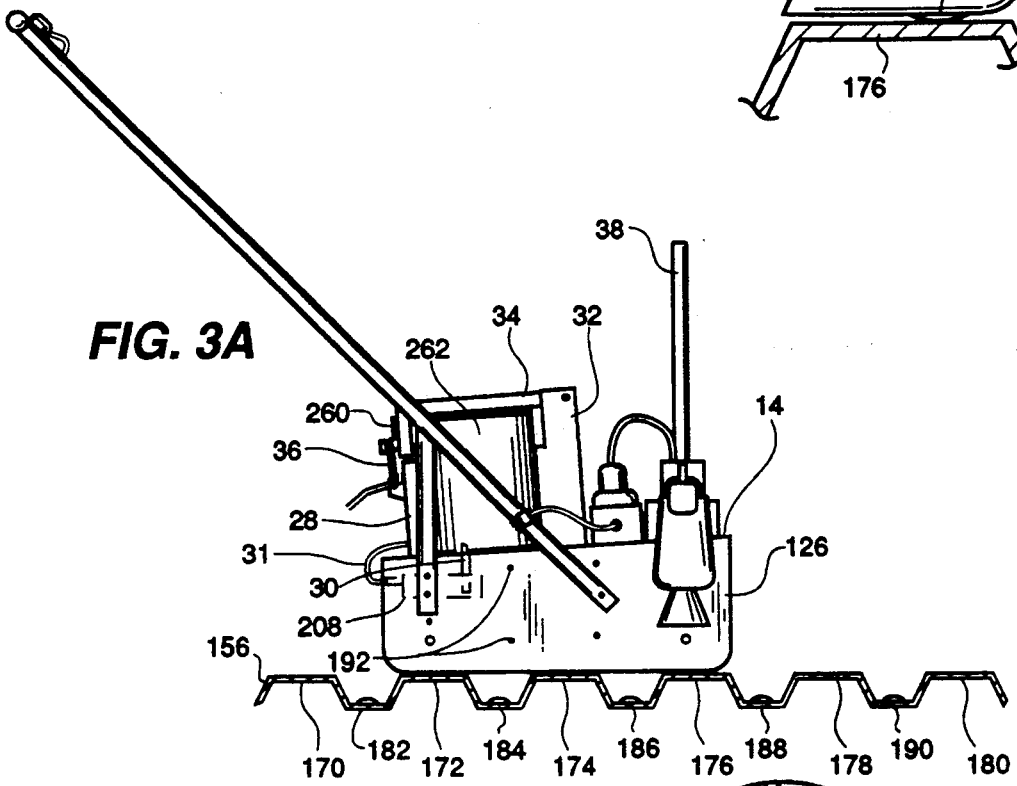
FIG. 3*a*, 3*b*, and 3*c* are side perspective view with hidden line illustration of the piercing valve and feeder body of the paint applicator shown in FIG. 1 and show the path of the front wheels of the paint applicator traveling across a flute, to a valley, back to a flute of the corrugated steel deck surface, respectively.
Figure 3B:
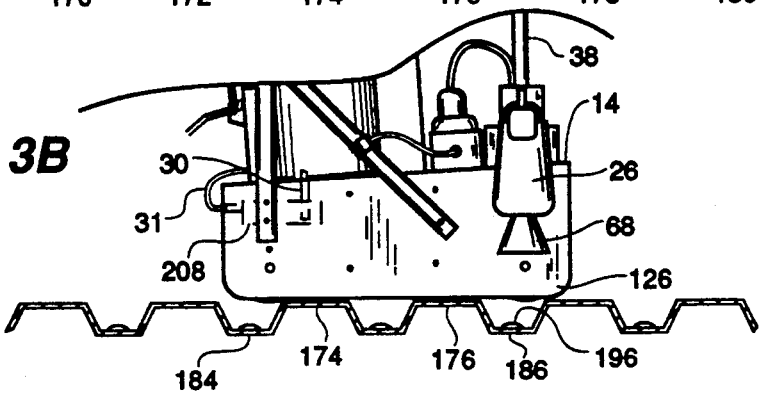
Figure 3C:
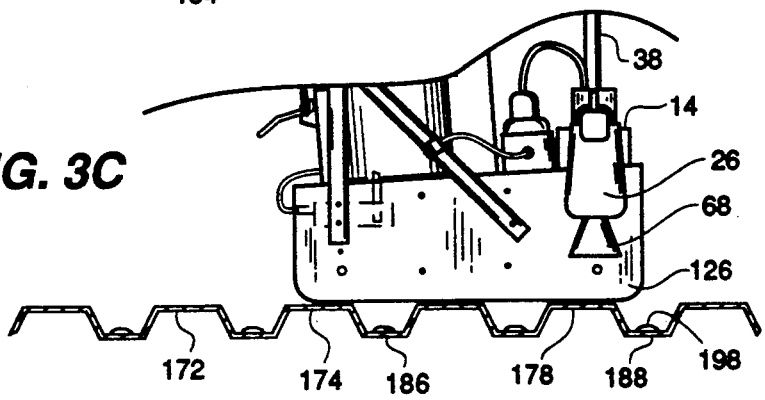

FIG. 3 is a side perspective view with hidden line illustration of the piercing valve 30 and feeder body 208 of the paint applicator constructed in accordance with the teachings of the present invention and shows at FIG. 3*a*, 3*b*, and 3*c* the path of the wheels of the vehicular paint applicator traveling across a flute, to a valley, and back to a flute of the corrugated steel decking 156, respectively. FIG. 3 illustrates flutes 170, 172, 174, 176, 178, and 180 and Corresponding valleys 182, 184, 186, 188, and 190. In FIG. 3*a* the rear wheels of the paint applicator rest upon flute 172 while the front wheels of the paint applicator rest upon flute 176. When the paint applicator is propelled by an operator's force on the handle in a forward direction the rear wheels thereof fall into valley 184 and the forward wheels fall into valley 188 only a limited distance due to skid guard 126 preventing at flutes 174 and 176 said wheels from falling into their respective valleys no more than ¼th of an inch. The skid guard is attached parallel to each side set of legs of the carriage body by a plurality of rivet screws 192 or other means for attachment and each skid guard 126 and 128 (See FIG. 8*c*) extends laterally between the wheels and extends downwardly beyond the carriage legs to a point 1/16th to ¼th of an inch above the bottom of the carriage wheels. FIG. 3*d* shows wheel 194 extending below skid guard 126 and riding atop flute 176. It is preferable that the skid guard extend downwardly beyond the wheels to a point 1/16th to ⅛th of an inch above the bottom of the wheels.

It is noteworthy that spray applicator 26 may be fixedly positioned on vertical rod 38 such as to have spray nozzle 68 set over weld 196 as front wheel 194 falls into the valley 188 wherein weld 196 is located. When set in this position skid guard 126 not only serves the function of preventing the wheels of the paint applicator from falling into the valleys of corrugated surfaces to a degree rendering the vehicle unduly bouncy while traversing corrugated surfaces but also allows the wheels of the paint applicator to fall into the valleys to a limited degree which can be sensed by the operator so as to give signal to the operator to then commence operation of the jog control switch 54 to direct the spray paint from paint sprayer 26 to cover the welds and/or screwheads. In this way the paint applicator of the present invention acts as a weld/screwhead locator whereby the spray applicator can be positioned in such spaced relation to the front wheels of the paint applicator as to directly hit the aligned welds and/or screwheads when the front wheels of the paint applicator hit a valley. FIG. 3*b* illustrates such a position of the paint applicator. FIG. 3*c* illustrates that the rear and front wheels of the paint applicator may easily "rebound" from the valleys onto the next flute of the corrugated surface such that if additional force is applied to the handle means the paint applicator may then move forward with its wheels atop flutes 174 and 178 and with additional force fall into valleys 186 and 188 such as to align the paint applicator to paint the next weld and/or screwhead 198.

FIG. 3*a* further illustrates the paint can hold base assembly 16 which includes hold base 28, piercing value 30 located forward of the hold base and rearward of arm base 32. Arm base 32 pivotally supports clamping arm 34 which when locked to hold base 28 by toggle lock 36 engaging lock arm 260 or other locking means forces paint container 262 over piercing valve 30 such as to puncture the paint container and gravity drain its contents through piercing valve 30 to feeder body 208 for communication therefrom by one or two outlet pipes to one or two corresponding suction delivery lines of an airless cup suction pump paint dispenser. Upper plate 14 of the carriage body is tilted from front to back, preferably one inch, to aid in the gravity drain of the paint container fluid through the piercing valve to the feeder body.

Figure 4:
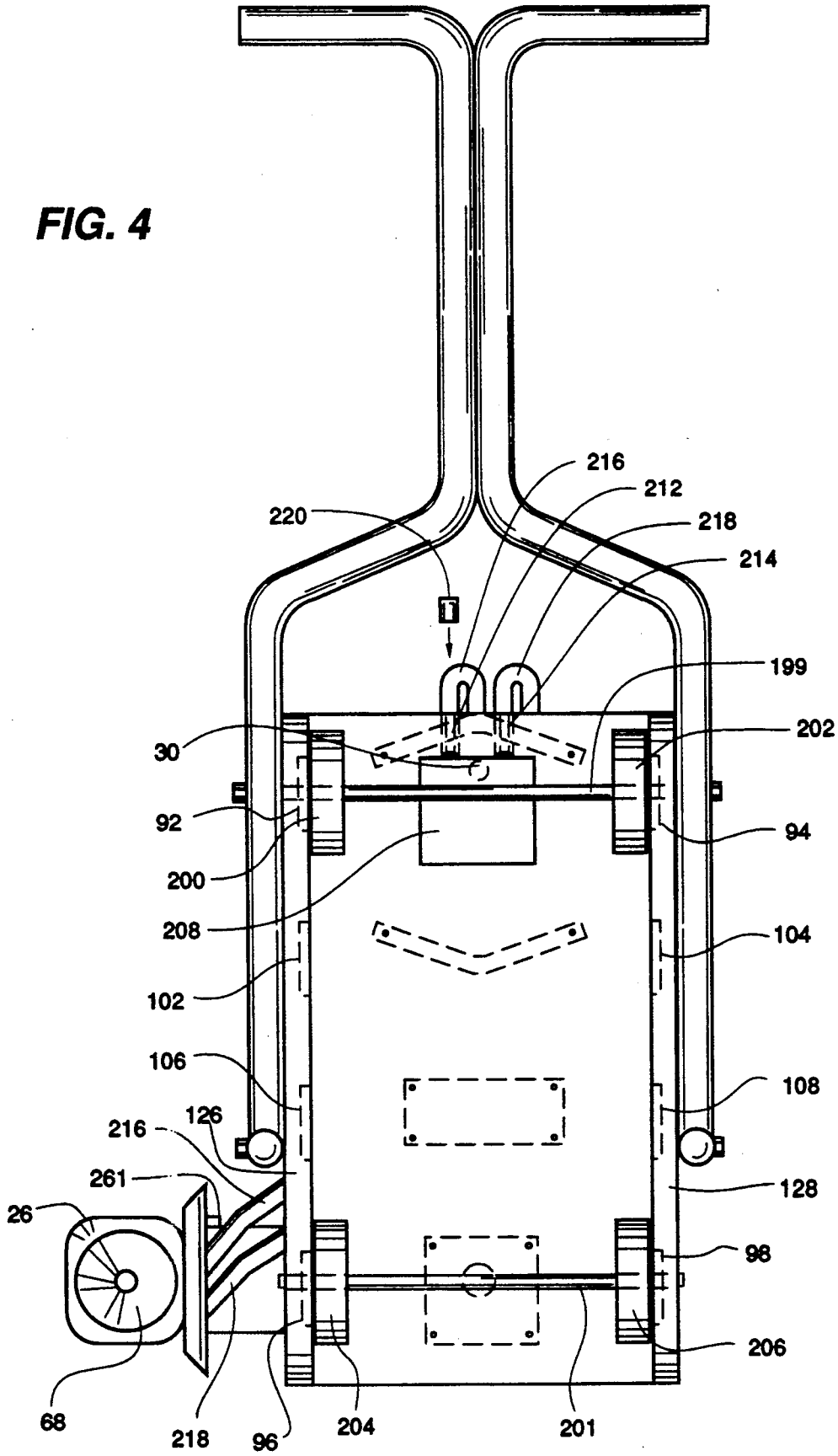
FIG. 4 is a bottom elevational view of the paint applicator and shows the skid guard, wheels, axles, and puncture valve feeder body, and suction delivery lines or block cap thereof together with the screw attachment of the various component parts of the paint applicator, namely the paint can hold base assembly, electric power assembly, and fixture for securing the paint dispenser in a fixed position.
Figure 8A:
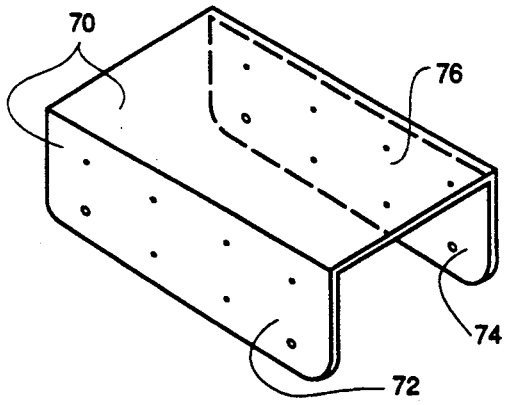
FIG. 8*a*, 8*b*, 8*c*, and 8*d* are perspective view with hidden lines of four different embodiments of the carriage body of the vehicular paint applicator of the present invention and shows at FIG. 8*a* a carriage body having two side walls opposite each other joined to an upper plate, at FIG. 8*b* a carriage body having four downwardly extending axle legs joined to an upper plate, at FIG. 8*c* a carriage having four downwardly extending axle legs and a plurality of downwardly extending support legs joined to an upper plate, all legs dimensioned to be received into a corresponding number of leg receiving cavities of a pair of skid guards illustrated exploded from the carriage body, and at FIG. 8*d* a carriage body having a plurality of downwardly extending axle legs joined to an upper plate, each leg being attached near the end of wheel bearing axles, a wheel tractor belt assembly for each side set of wheels, and a limit sensing switch mounted to a wheel aligned between the front wheels of the carriage body.
Figure 8B:
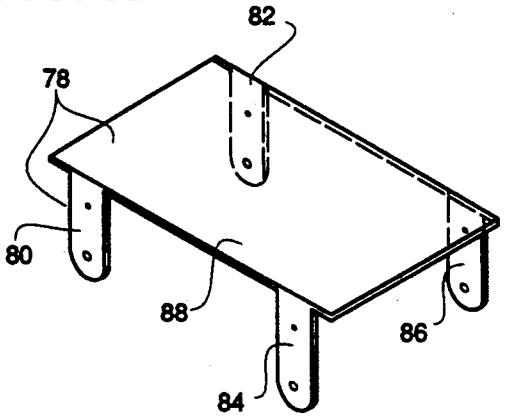
Figure 8C:
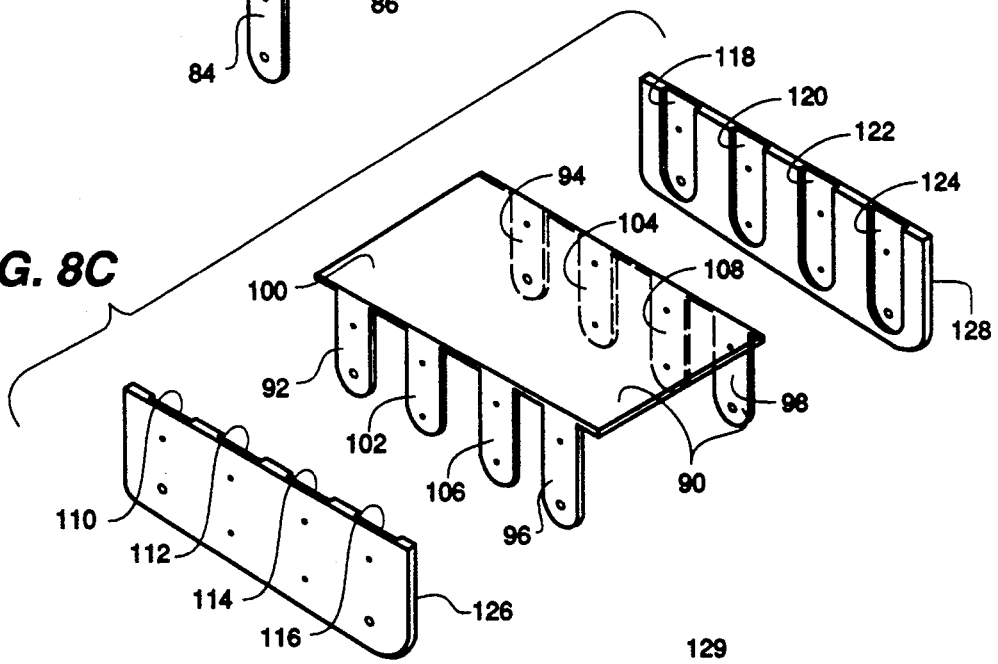
Figure 8D:
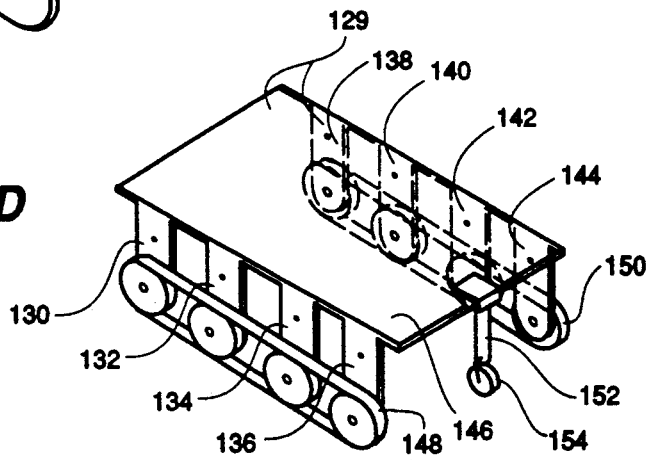

FIG. 4 is a bottom elevational view of the preferred embodiment of the paint applicator utilizing the carriage body shown at FIG. 8*c* and shows skid guards 126 and 128 attached parallel to carriage body axle legs 92, 94, 96, and 98 and support legs 102, 104, 106, and 108. Rear axle 199 bears wheels 200 and 202. Front axle 201 bears wheels 204 and 206. FIG. 4 further illustrates valve feeder body 208. Feeder body 208 serves as a pooling reservoir for paint communicated to it by piercing valve 30 of paint can hold assembly 16. The feeder body 208 communicates paint to outlet pipes 212 and 214 extending from said feeder body which are suited for hose communication with two delivery hose lines 216 and 218 of an airless cup suction pump paint dispenser 26. For an airless cup suction pump paint dispenser having only one deliver hose, such as delivery hose 31 shown in FIGS. 1, 2, and 3, cap 220 may engage one outlet pipe or the paint applicator may be constructed to provide only one outlet pipe from the feeder body. FIG. 4 also illustrates that the paint dispenser 26 may have its spray nozzle 68 positioned aligned to front axle 201.

Figure 5:
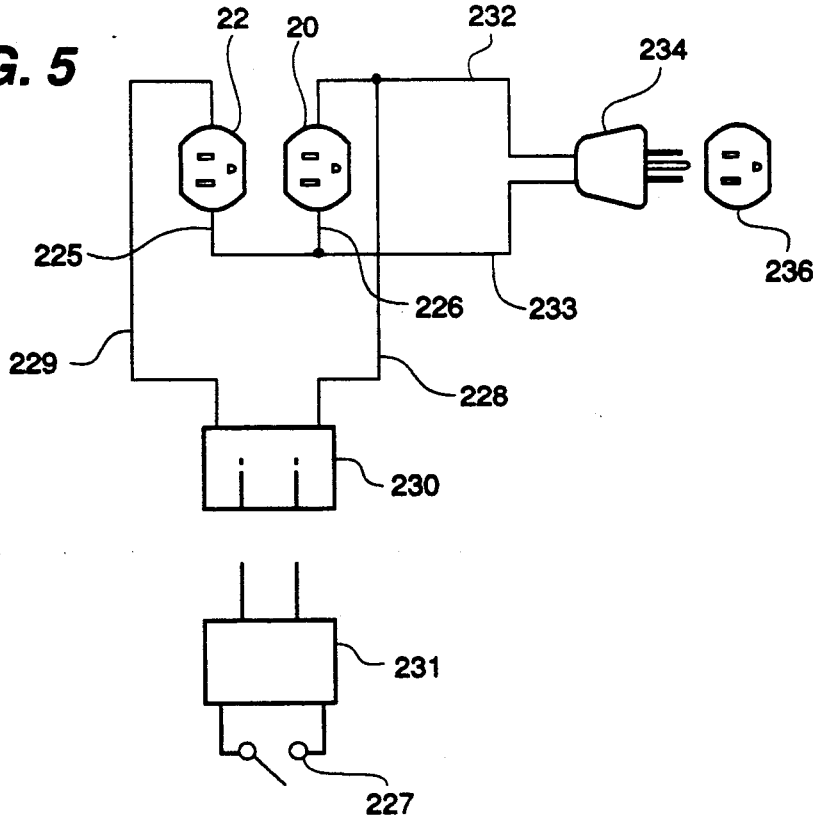
FIG. 5 is a schematic illustration of the electrical power assembly of the paint applicator and shows two electrical outlets, one live outlet for electric circuit communication with a power source, and another switch outlet for electric circuit operation of an airless cup suction pump paint dispenser by a jog control switch capable of selectively activating an electric circuit to initiate and terminate the release of paint from the paint dispenser as desired, and further shows quick disconnect plugs to the jog control line.

FIG. 5 is a schematic illustration of the electrical power assembly 18 of the paint applicator. The electric power assembly includes three sets of interconnecting electric lines providing an electric circuit to at least two electrical outlets, one switched electrical outlet 22 and one live electrical outlet 20. A standard duplex receptacle electrical outlet with its shorting tab removed from the live side line may serve as the two electrical outlets. The electric outlets 20 and 22 are in communication with each other by interconnecting circuit lines 225 and 226 and are in communication with a jog control switch 227 by interconnecting electric lines 228 and 229 terminating into a female quick disconnect plug 230 for mating with a male quick disconnect plug 231 the jog control 227. If a quick disconnect fitting is utilized with the jog control, such fitting of course would not be located in that portion of the electric line 66 in FIG. 2 internal to handle means 51, but rather would be in that portion of line 66 external to the handle means. The switched outlet 22 receives the male plug of a power cord of an airless cup suction pump paint dispenser for electric circuit communication with a jog control switch capable of selectively activating an electric circuit to initiate and terminate the release of paint from the airless cup suction pump paint dispenser as desired. The live outlet 20 is supplied with electric power by interconnecting electric lines 232 and 233 terminating into male plug 234 which, directly or with the aid of an extension cord, establishes electric circuit communication with an appropriate electrical power source 236, preferably a 120 volt AC circuit, or alternatively, a battery or generator electrical source.

Figure 7:
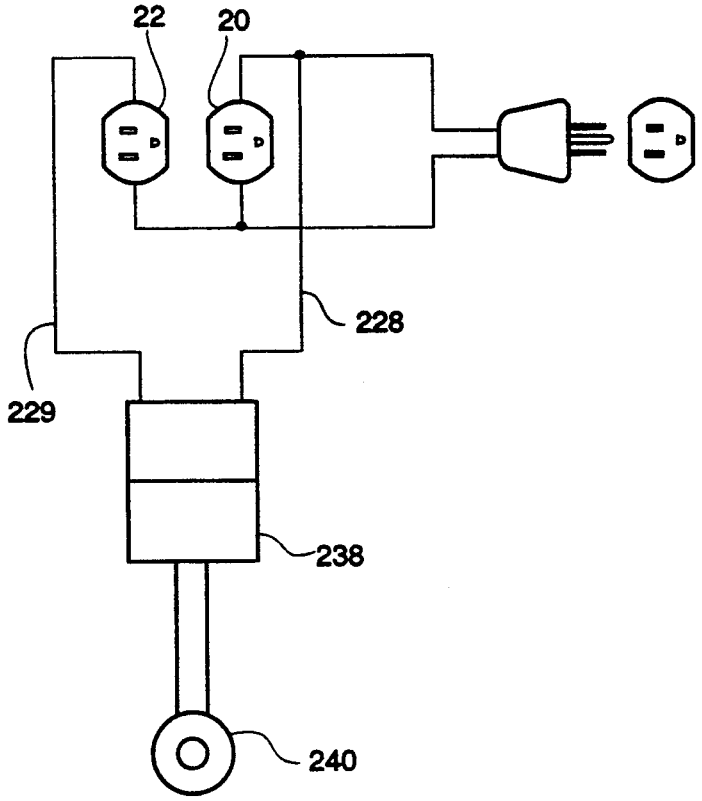
FIG. 7 is a schematic illustration of the power assembly of the wheel tractor belt assembly embodiment of the paint applicator and shows two electrical outlets, one live outlet for electric circuit communication with a power source and another outlet for electric circuit operation of an airless cup suction pump paint dispenser by a limit switch capable of sensing the fall of the front wheels of the paint applicator from a flute into a valley of corrugated surface to allow electric circuit dispersal of a limited or controlled burst of paint.

FIG. 7 is a schematic illustration of the electrical power assembly 18 of a paint applicator having a wheel tractor-belt assembly. FIG. 7 is similar to FIG. 5 except that interconnecting lines 229 and 228 terminate into limit switch 238 located atop wheel 240 instead of the quick disconnect plugs for a jog control switch dispersal of paint. When limit switch 238 atop wheel 240 contracts while moving atop the flutes of a corrugated surface then electric circuit power for paint dispenser 26 would be shut-off. When limit switch 238 atop wheel 240 extends into the valley of a corrugated decking, then the electric circuit is complete to trigger electric circuit dispersal of paint from paint dispenser 26. Use of a limit switch is disadvantageous in that such a device would paint every valley of a corrugated surface although welds and /or screwheads may not exist in every valley. Additionally, such machine may not be operable in a continuous spray paint manner.

Figure 6:
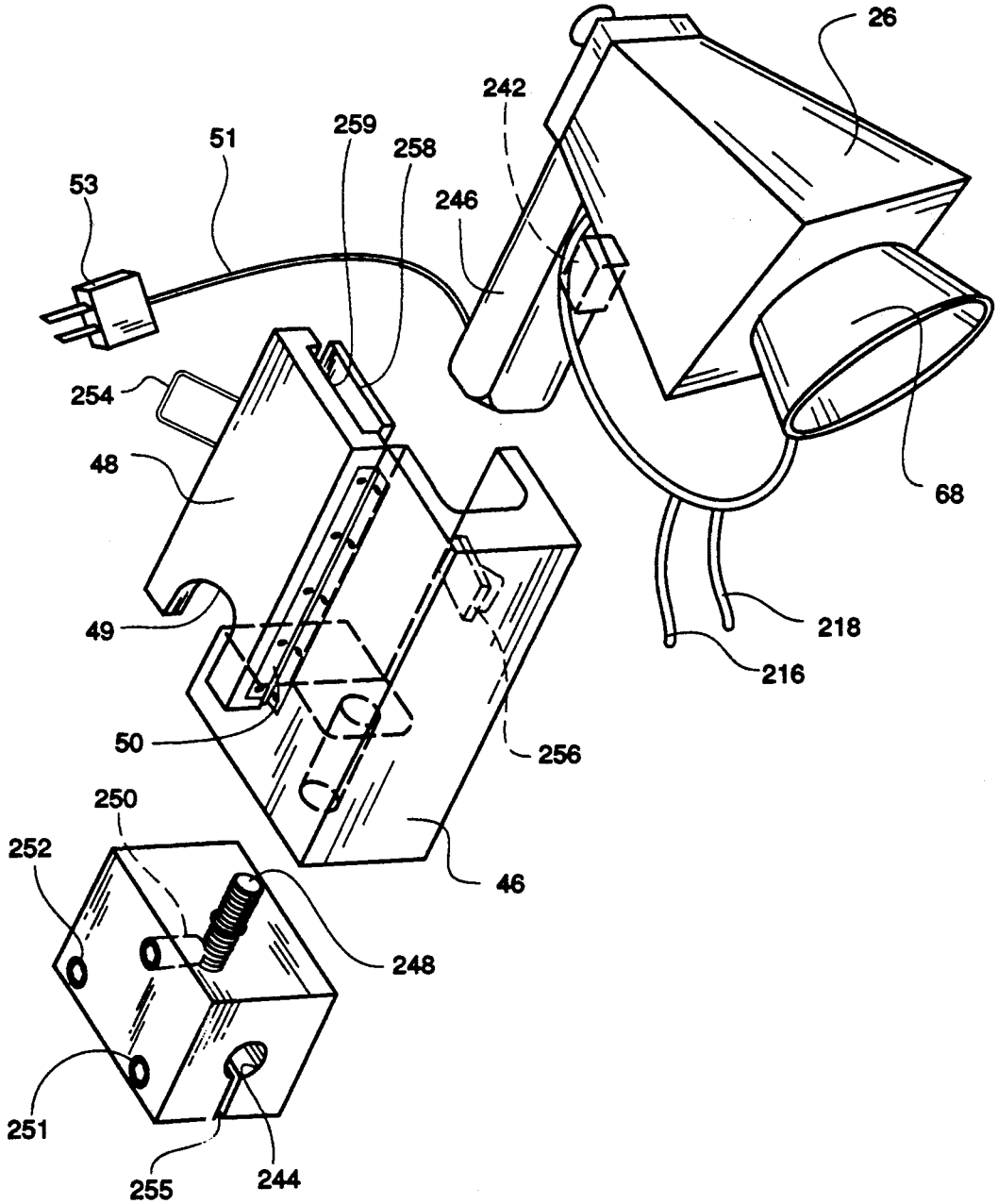
FIG. 6 is a perspective exploded view with hidden lines of the three piece horizontal arm of the detachable horizontal arm of the paint applicator capable of locking a squeeze trigger of an airless cup suction pump paint dispenser in operational mode.

FIG. 6 is a perspective exploded view of the three piece construction of the detachable horizontal arm 42 of the paint applicator capable of locking a squeeze trigger 242 of an airless cup suction pump paint dispenser 26 in operational mode. The detachable horizontal arm includes clamping portion 44 having a vertical hole 244 capable of engaging vertical rod 38 attached to the carriage body. First arm portion 46 is contoured to support hand/trigger arm 246 of an airless cup suction pump paint dispenser and also engages the clamping portion 44 by shoulder bolt 248. Clamping portion 44 further includes set screws 250, 251, and 252. Set screw 251 and 252 can be tightened to close gap 255 of clamping portion 44 to secure the clamping portion to vertical rod 38. Set screw 250 can be tightened against shoulder bolt 248 to lock rotational position of the first and second arm portions. Second arm portion 48 is hinged to the first arm portion 46 by hinge 50 common to each. Toggle lock clamp 254 engages clamp arm 256 to secure the second arm portion to the first arm portion thereby encapturing squeeze trigger 242 of power paint dispenser 26 in operational mode when so locked to the first arm portion. A spacer 258 may be provided to rest between inner surface 259 of the second arm portion 48 and hand/trigger arm 246 of paint dispenser 26 to fully engage the squeeze trigger 242 the paint dispenser when first arm portion is locked into the second arm portion. Second arm portion 48 has cavity 49 permitting power cord 51 of paint dispenser 26 to escape from and extend out of the first and second arm portions when they are locked together. Male plug 53 then is free to engage switched electrical outlet 22.

Figure 9:
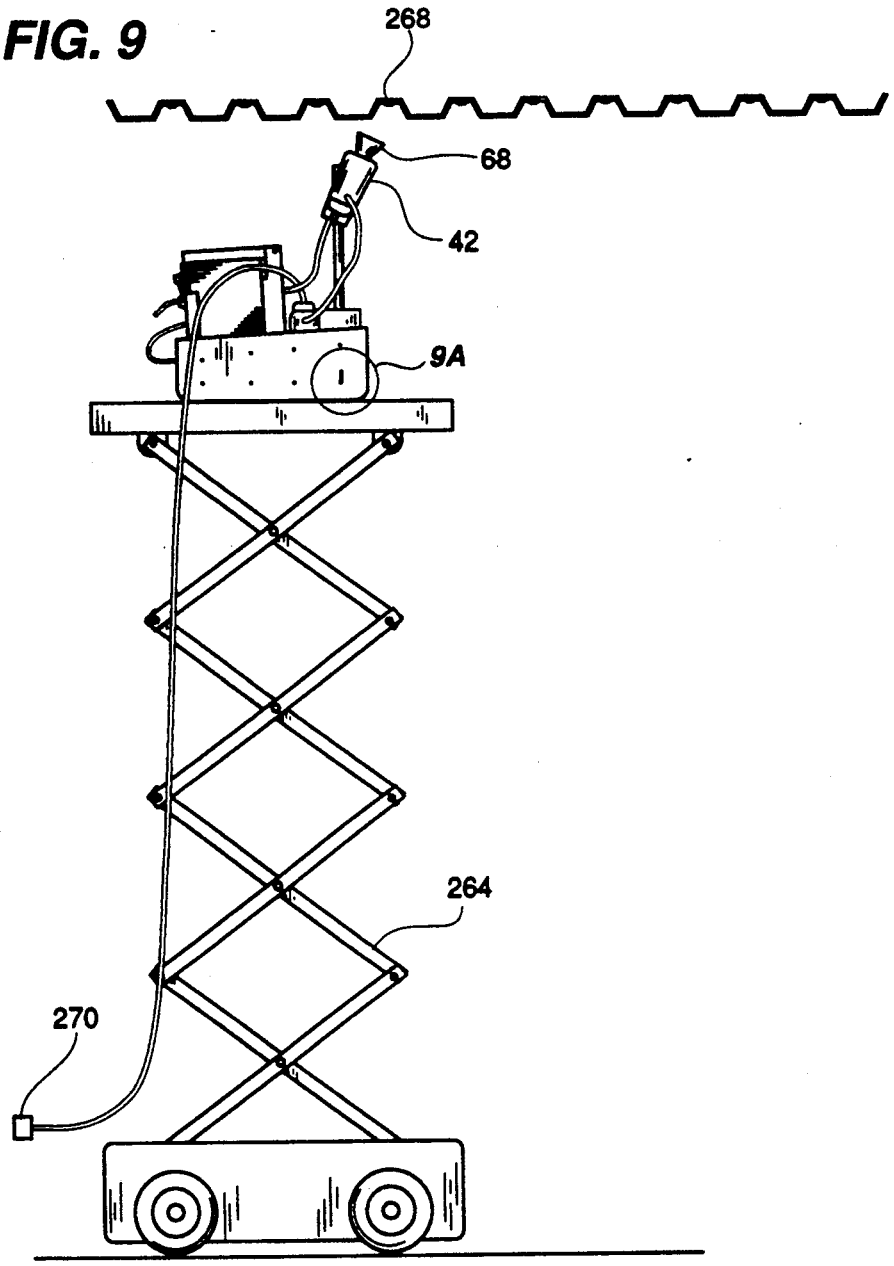
FIG. 9 is a side perspective view of the paint applicator of the present invention with its handle means detached set atop a moveable scaffold or aerial lift with its wheels locked by a locking pin.
Figure 9A:
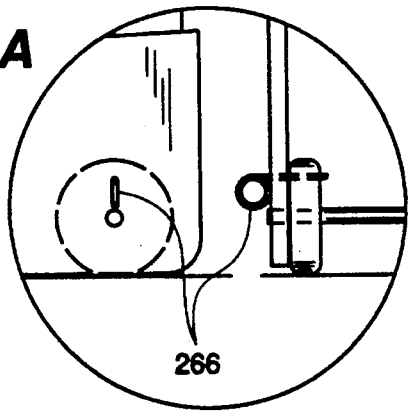
FIG. 9*a* shows the horizontal arm inverted to position the paint dispenser to spray a corrugated ceiling surface upon command of a remote jog control.

FIG. 9 is a side perspective view of the paint applicator of the present invention with its handle means detached fixedly set atop a moveable scaffold or aerial lift 264 by means of wheel pin lock 266 to all of the paint applicator wheels (see FIG. 9*a*). FIG. 9 further shows the detachable horizontal arm now set to an inverted position so as to direct the spray of the paint dispenser 26 to a corrugated ceiling surface 268 upon command of remote control jog switch 270.

Suitable airless cup suction pump paint dispensers for use with the subject invention include the "Power-Flo" (trademark) heavy duty paint sprayer of Power-Flo Products Corp. 1661 94th Lane N. E., Minneapolis, MN 55434 or the "Power Painting System 355E" of Wagner Spray Tech Corp., P.O. Box 9362, 1770 Fern Brook Lane, Minneapolis, MN 55447. Each of these power paint dispensers are readily available commercially as well as other similar and suitable power paint dispensers. Such power paint dispensers have a hand/trigger arm and squeeze trigger capable of being engaged in operational mode by the locked first and second arm portions of the detachable horizontal arm of the vehicular paint applicator of the present invention. Suitable power paint dispensers may have one suction delivery line as illustrated in FIGS. 1, 2, and 3 with delivery line 31 or two suction delivery lines as illustrated with delivery lines 216 and 218 in FIGS. 4 and 6. Dual suction line units usually have an overflow line assigned to one of the two suction lines.

Suitable power paint dispensers may advantageously be detached from the present invention and used in its normal capacity apart from the present invention. Additionally, the power paint dispenser can be used in conjunction with the present invention in a continuous spray mode as opposed to intermittent spray via continuous pressure applied to jog control 54. After each paint application by the present invention it is suggested that a cleaning tube from turpentine or other cleaning source be set over the piercing valve 30 of the present invention such as to allow the power paint suction line to draw the turpentine or cleaner through piercing valve 30 into the feeder body 208 and out into the spraying line and through the power paint unit such as to leave the power paint dispenser and conduit thereof clean and primed ready for the next application.

The term axle as used in this Specification and Claims may mean an axle sufficient to support one wheel, the term not always necessarily indicating an axle supporting two wheels.

It is believed that the automatic intermittent or continuous vehicular paint applicator for corrugated surfaces of the present invention in its described embodiments and with its numerous attended advantages will be fully understood from the foregoing description, and that changes may be made in form, construction, and arrangement of the several parts thereof without departing from the spirit or scope of the invention, or sacrificing any of the attendant advantages. The structure herein disclosed are preferred embodiments for the purpose of illustrating the best mode of invention contemplated by the inventor and to best explain the principals of the invention and its application and practical use to thereby enable others to make and utilize the invention. The preferred embodiments illustrated are not intended to be exhaustive or to limit the invention to the precise form disclosed. Accordingly, the scope of the invention is only to be limited as necessitated by the accompanying claims.

I claim:

1. A continuous or intermittent paint applicator for applying paint to a desired surface, comprising:

(A) a carriage body having two side walls opposite each other integral with or joined to an upper plate, each side wall being attached near separate ends of a pair of wheel bearing axles;

(B) a wheel roller-skid assembly having four wheels each of which are rotatably mounted near separate ends of said pair of wheel bearing axles, and a first skid guard attached adjacent to one side wall and a second skid guard attached adjacent to the other side wall, each skid guard extending laterally between the wheels on the same side of each side wall and extending downwardly beyond said side wall to a point 1/16th to ¼th inch above the bottom of said wheels;

(C) handle means attachable to said carriage body and extending upwardly therefrom for gripping by an operator to push or pull said carriage body relative to said surface;

(D) an electric power assembly mounted to said carriage body including interconnecting electric lines providing an electric circuit, and at least two electrical outlets, one for electric circuit communication with an electric power source, and the other for electric circuit operation of an airless cup suction pump paint dispenser by a jog control switch capable of selectively activating an electric circuit to initiate and terminate the release of paint from said paint dispenser as desired;

(E) means attached to the carriage body for holding a paint container in fluid communication with means for delivering the contents of the paint container to a suction delivery line of said paint dispenser for spraying therefrom;

(F) a fixture for securing fixed position including a vertical rod attached to said carriage body at its lower end and mountably supporting a detachable horizontal arm at a selectable distance above said lower end, said detachable horizontal arm including means for clamping said arm to the vertical rod in adjustable position vertically, traversely, or invertedly, and having two portions, a first portion capable of being locked to a second portion to, when locked together, secure a squeeze trigger of said paint dispenser in operational mode.

2. The carriage paint applicator of claim 1 wherein each of said wheels rotate substantially in a plane parallel with the plane of rotation of each other wheel for movement of said carriage body in a substantially straight line in response to a force applied to said handle means by an operator.

3. The carriage paint applicator of claim I wherein the upper plate of said carriage body is tilted.

4. The carriage paint applicator of claim 1 wherein the electric outlet for electric circuit operation of said paint dispenser is normally biased to a non-working position wherein an electric circuit is not operable to release paint from said paint dispenser and is responsive to the operation of a jog switch for releasing paint from said paint dispenser.

5. The carriage paint dispenser of claim 1 wherein one of said interconnecting electrical lines providing an electric circuit is fitted with a quick disconnect electric plug fitting for the jog control.

6. The carriage paint dispenser of claim 1 wherein the means attached to the carriage body for holding a paint container in fluid communication with means for delivering the fluid contents of the paint container to a suction delivery line of the paint dispenser for spraying therefrom includes a paint can hold base assembly comprising a paint can hold wall and an arm support base, each mounted to the upper plate of the carriage body and positioned in such spaced relation to each other as to secure a paint container therebetween or a paint container and a spacer therebetween, said arm support base pivotally supporting a clamping arm having means for locking said clamping arm with said paint can hold wall, and a piercing valve located between said hold wall and support base and extending upward from said upper plate, said piercing valve being in fluid communication with means attached to the carriage body for delivering the contents of the paint can to a suction delivery line of said paint dispenser for spraying therefrom.

7. The carriage paint dispenser of claim 6 wherein the means for delivering the contents of the paint can to a suction delivery line of said paint dispenser comprises a feeder reservoir having an outlet pipe extending therefrom, said feeder reservoir being mounted to the lower surface of the upper plate and beneath said piercing valve such that when the clamping arm is locked to the paint can hold wall the bottom of a paint can is punctured by the piercing valve to provide gravity drain communication of the paint can contents to said feeder reservoir for feeder pipe delivery of the paint to a delivery line of an airless cup suction pump paint dispenser.

8. The carriage paint dispenser of claim 7 wherein the means for delivering the contents of the paint can to a suction delivery line of said paint dispenser further comprises a second outlet pipe extending from the feeder reservoir for communication with either an overflow line of said paint dispenser or a locking cap.

9. The carriage paint dispenser of claim 6 wherien the means for locking the clamping arm with the paint can hold base comprises a toggle lock attached to said paint can hold base wall for cooperation with a receiving end of said clamping arm.

10. The carriage paint dispenser of claim 6 wherein the piercing valve is a replaceable cylinder having an upper angled piercing edged end extending above said upper plate and having a hole above its lower end and beneath said upper plate, said lower end being supported by the floor surface of said feeder reservoir.

11. The carriage paint dispenser of claim 1 further including wheel locking means.

12. A continuous or intermittent paint applicator for applying paint to a desired surface, comprising:

(A) a carriage body having four downwardly extending axle legs integral with or joined to an upper plate, each leg being attached near separate ends of a pair of wheel bearing axles;

(B) a wheel roller-skid assembly having four wheels each of which are rotatably mounted near separate ends of said pair of wheel bearing axles, and a first skid guard attached adjacent to one side set of axle legs and a second skid guard attached adjacent to the other side set of axle legs, each skid guard extending laterally between each side set of axle legs and extending downwardly beyond said legs to a point 1/16th to ¼th inch above the bottom of said wheels;

(C) handle means attachable to said carriage body and extending upwardly therefrom for gripping by an operator to push or pull said carriage body relative to said surface;

(D) an electric power assembly mounted to said carriage body including interconnecting electric lines providing an electric circuit, and at least two electrical outlets, one for electric circuit communication with an electric power source, and the other for electric circuit operation of an airless cup suction pump paint dispenser by a jog control switch capable of selectively activating an electric circuit to initiate and terminate the release of paint from said paint dispenser as desired;

(E) means attached to the carriage body for holding a paint container in fluid communication with means for delivering the contents of the paint container to a suction delivery line of said paint dispenser for spraying therefrom;

(F) a fixture for securing said paint dispenser inn a fixed position including a vertical rod attached to said carriage body at its lower end and mountably supporting a detachable horizontal arm at a selectable distance above said lower end, said detachable horizontal arm including means for clamping said arm to the vertical rod in adjustable position vertically, traversely, or invertedly, and having two portions, a first portion capable of being locked to a second portion to, when locked together, secure a squeeze trigger of said paint dispenser in operational mode.

13. The carriage paint applicator of claim 12 wherein each of said wheels rotate substantially in a plane parallel with the plane of rotation of each other wheel for movement of said carriage body in a substantially straight line in response to a force applied to said handle means by an operator.

14. The carriage paint applicator of claim 12 wherein the upper plate of said carriage body is tilted.

15. The carriage paint applicator of claim 12 wherein the electric outlet for electric circuit operation of said paint dispenser is normally biased to a non-working position wherein an electric circuit is not operable to release paint from said paint dispenser and is responsive to the operation of a jog switch for releasing paint from said paint dispenser.

16. The carriage paint dispenser of claim 12 wherein one of said interconnecting electrical lines providing an electric circuit is fitted with a quick disconnect electric plug fitting for the jog control.

17. The carriage paint dispenser of claim 12 wherein the means attached to the carriage body for holding a paint container in fluid communication with means for delivering the fluid contents of the paint container to a suction delivery line of the paint dispenser for spraying therefrom includes a paint can hold base assembly comprising a paint can hold wall and an arm support base, each mounted to the upper plate of the carriage body and positioned in such spaced relation to each other as to secure a paint container therebetween or a paint container and a spacer therebetween, said arm support base pivotally supporting a clamping arm having means for locking said clamping arm with said paint can hold wall, and a piercing valve located between said hold wall and support base and extending upward from said upper plate, said piercing valve being in fluid communication with means attached to the carriage body for delivering the contents of the paint can to a suction delivery line of said paint dispenser for spraying therefrom.

18. The carriage paint dispenser of claim 17 wherein the means for delivering the contents of the paint can to a suction delivery line of said paint dispenser comprises a feeder reservoir having an outlet pipe extending therefrom, said feeder reservoir being mounted to the lower surface of the upper plate and beneath said piercing valve such that when the clamping arm is locked to the paint can hold wall the bottom of a paint can is punctured by the piercing valve to provide gravity drain communication of the paint can contents to said feeder reservoir for feeder pipe delivery of the paint to a delivery line of an airless cup suction pump paint dispenser.

19. The carriage paint dispenser of claim 17 wherein the means for delivering the contents of the paint can to a suction delivery line of said paint dispenser further comprises a second outlet pipe extending from the feeder reservoir for communication with either an overflow line of said paint dispenser or a locking cap.

20. The carriage paint dispenser of claim 17 wherein the means for locking the clamping arm with the paint can hold wall comprises a toggle lock attached to said paint can hold wall for cooperation with a receiving end of said clamping arm.

21. The carriage paint dispenser of claim 17 wherein the piercing valve is a replaceable cylinder having an upper angled piercing edged end extending above said upper plate and having a hole above its lower end and beneath said upper plate, said lower end being supported by the floor surface of said feeder reservoir.

22. The carriage paint dispenser of claim 12 further including wheel locking means.

23. A continuous or intermittent paint applicator for applying paint to a desired surface, comprising:

(A) a carriage body having four downwardly extending axle legs integral with or joined to an upper plate, each leg being attached near separate ends of a pair of wheel bearing axles and a plurality of downwardly extending skid guard support legs integral with or joined to said upper plate and positioned between each side set of axle legs;

(B) a wheel roller-skid assembly having four wheels each of which are rotatably mounted near separate ends of said pair of wheel bearing axles, and a first and second skid guard, each skid guard having a plurality of leg receiving cavities downwardly extending from the upper edge of the skid guard and between the outer and inner surfaces of the skid guard, said cavities dimensioned to receive said four axle legs and a corresponding plurality of skid guard support legs, and each skid guard extending laterally between each side set of axle legs and extending downwardly beyond said axle legs and skid guard support lens to a point 1/16th to ¼th inch above the bottom of said wheels;

(C) handle means attachable to said carriage body and extending upwardly therefrom for gripping by an operator to push or pull said carriage body relative to said surface;

(D) an electric power assembly mounted to said carriage body including interconnecting electric lines providing an electric circuit, and at least two electrical outlets, one for electric circuit communication with an electric power source, and the other for electric circuit operation of an airless cup suction pump paint dispenser by a jog control switch capable of selectively activating an electric circuit to initiate and terminate the release of paint from said paint dispenser as desired;

(E) means attached to the carriage body for holding a paint container in fluid communication with means for delivering the contents of the paint container to a suction delivery line of said paint dispenser for spraying therefrom;

(F) a fixture for securing said paint dispenser in a fixed position including a vertical rod attached to said carriage body at its lower end and mountably supporting a detachable horizontal arm at a selectable distance above said lower end, said detachable horizontal arm including means for clamping said arm to the vertical rod in adjustable position vertically, traversely, or invertedly, and having two portions, a first portion capable of being locked to a second portion to, when locked together, secure a squeeze trigger of said paint dispenser in operational mode.

24. The carriage paint applicator of claim 23 wherein each of said wheels rotate substantially in a plane parallel with the plane of rotation of each other wheel for movement of said carriage body in a substantially straight line in response to a force applied to said handle means by an operator.

25. The carriage paint applicator of claim 23 wherein the upper plate of said carriage body is tilted.

26. The carriage paint applicator of claim 23 wherein the electric outlet for electric circuit operation of said paint dispenser is normally biased to a non-working position wherein an electric circuit is not operable to release paint from said paint dispenser and is responsive to the operation of a jog switch for releasing paint from said paint dispenser.

27. The carriage paint dispenser of claim 23 wherein one of said interconnecting electrical lines providing an electric circuit is fitted with a quick disconnect electric plug fitting for the jog control.

28. The carriage paint dispenser of claim 23 wherein the means attached to the carriage body for holding a paint container in fluid communication with means for delivering the fluid contents of the paint container to a suction delivery line of the paint dispenser for spraying therefrom includes a paint can hold base assembly comprising a paint can hold wall and an arm support base, each mounted to the upper plate of the carriage body and positioned in such spaced relation to each other as to secure a paint container therebetween or a paint container and a spacer therebetween, said arm support base pivotally supporting a clamping arm having means for locking said clamping arm with said paint can hold wall, and a piercing valve located between said hold wall and support base and extending upward from said upper plate, said piercing valve being in fluid communication with means attached to the carriage body for delivering the contents of the paint can to a suction delivery line of said paint dispenser for spraying therefrom.

29. The carriage paint dispenser of claim 28 wherein the means for delivering the contents of the paint can to a suction delivery line of said paint dispenser comprises a feeder reservoir having an outlet pipe extending therefrom, said feeder reservoir being mounted to the lower surface of the upper plate and beneath said piercing valve such that when the clamping arm is locked to the paint can hold wall the bottom of a paint can is punctured by the piercing valve to provide gravity drain communication of the paint can contents to said feeder reservoir for feeder pipe delivery of the paint to a delivery line of an airless cup suction pump paint dispenser.

30. The carriage paint dispenser of claim 28 wherein the means for delivering the contents of the paint can to a suction delivery line of said paint dispenser further comprises a second outlet pipe extending from the feeder reservoir for communication with either an overflow line of said paint dispenser or a locking cap.

31. The carriage paint dispenser of claim 28 wherein the means for locking the clamping arm with the paint can hold wall comprises a toggle lock attached to said paint can hold wall for cooperation with a receiving end of said clamping arm.

32. The carriage paint dispenser of claim 28 wherein the piercing valve is a replaceable cylinder having an upper angled piercing edged end extending above said upper plate and having a hole above its lower end and beneath said upper plate, said lower end being supported by the floor surface of said feeder reservoir.

33. The carriage paint dispenser of claim 23 further including wheel locking means.

* * * * *